US008905048B2

(12) United States Patent
Peterson et al.

(10) Patent No.: US 8,905,048 B2
(45) Date of Patent: Dec. 9, 2014

(54) INVISIBLE LACE WEFT

(71) Applicants: Samuel Peterson, Sunny Isles, FL (US); Darius Johnson, Fort Lauderdale, FL (US)

(72) Inventors: Samuel Peterson, Sunny Isles, FL (US); Darius Johnson, Fort Lauderdale, FL (US)

( * ) Notice: Subject to any disclaimer, the term of this patent is extended or adjusted under 35 U.S.C. 154(b) by 0 days.

(21) Appl. No.: 13/750,718

(22) Filed: Jan. 25, 2013

(65) Prior Publication Data

US 2014/0326267 A1 Nov. 6, 2014

Related U.S. Application Data

(60) Provisional application No. 61/590,480, filed on Jan. 25, 2012.

(51) Int. Cl.
*A41G 5/00* (2006.01)
*A41G 3/00* (2006.01)

(52) U.S. Cl.
CPC ..... *A41G 5/004* (2013.01)
USPC ..... 132/201; 132/53

(58) Field of Classification Search
CPC ... A41G 5/004; A41G 5/0046; A41G 5/0053; A41G 5/008; A41G 3/00; A41G 3/0008; A41G 3/0025; A41G 3/0041; A41G 3/005; A41G 3/0075
USPC ..... 132/201, 53–56
See application file for complete search history.

(56) References Cited

U.S. PATENT DOCUMENTS

| | | | | | |
|---|---|---|---|---|---|
| 1,740,764 | A * | 12/1929 | Bong | ..... | 132/201 |
| 3,970,092 | A * | 7/1976 | Nelson | ..... | 132/201 |
| 5,899,211 | A * | 5/1999 | Brown | ..... | 132/201 |
| 2012/0234338 | A1* | 9/2012 | Verbonac | ..... | 132/201 |
| 2013/0133680 | A1* | 5/2013 | Wang | ..... | 132/201 |

* cited by examiner

*Primary Examiner* — Rachel Steitz

(57) ABSTRACT

An essentially invisible lace weft hair extension comprising a first layer of lace, extension hair knotted into the first layer to define a weft base, a knot sealant/bonding agent applied to the weft base, and a second layer of lace bonded to the first layer over the weft base. The weft base is double-bleached (both lace and knots), preferably before the knot sealant/bonding agent is applied. Methods for constructing the weft, and for applying the weft to a wearer's scalp using adhesive, are also disclosed.

19 Claims, 6 Drawing Sheets

INVISIBLE LACE WEFT

RELATED APPLICATIONS/PRIORITY BENEFIT CLAIM

This application claims the benefit of U.S. Provisional Application No. 61/590,480, filed Jan. 25, 2012 by the same inventors (Peterson and Johnson), the entirety of which provisional application is hereby incorporated by reference.

FIELD

The subject matter of the present application is in the field of temporary hair extensions for the human head, in particular weft extensions.

BACKGROUND

Hair extensions comprise artificial or natural hair secured to a base adapted to be temporarily attached to a wearer's natural hair or scalp. Techniques include bonding, tracking, fusion, "NoBraids NoGlue", netting, tree braiding, clip-on extensions, micro braiding, and lace extensions.

Lace extensions are generally limited to full "units" (full wigs or hairpieces). Lace extension units are made from nylon mesh ("lace") formed into a cap, into whose openings single strands of hair are knotted. Lace extension units can be woven into the wearer's hair by inserting the wearer's own strands of hair through the mesh side-by-side with the extension's hair and knotting the natural hair into the lace next to the extension hair; by sewing into the wearer's hair; or, by gluing the lace edges to the hairline with special adhesives. Lace extension units are relatively flexible and natural-looking, the lace is relatively difficult to detect, and the extension units can be left in place for weeks at a time.

Many people, however, do not need a full extension unit, and often prefer to use directional "wefts", which are individual, narrow hair extension strips secured to a wearer's head anywhere the hair can be parted horizontally. Wefts are cut to length at the time of application, and are generally sewn or taped to the wearer's hair along the part.

While different types of weft are known, the higher quality ones are generally "skin wefts" using a polyurethane base with the extension hair injected into the base. Skin/poly wefts are relatively stiff, and, although easy to work with, tend to suffer with respect to looking natural. Their longevity also tends to be limited, and they generally must be sewn into the wearer's hair. It is also known to use "tape wefts" with bases taped to the wearer's hair along the part line, but these tend to be of lower quality and their longevity is less than that of the skin/poly wefts.

Lace extensions have generally not been used for wefts. One possible reason is that the knots in a lace extension tend to be more noticeable in a weft than in a full extension unit. The lace is delicate, and would be difficult to cut to length without unraveling and "humping". Because the openings in the lace tend to be filled by the knotted extension hair, there would be little room for weaving the wearer's hair through the weft, making weaving overly time-consuming and labor-intensive. And, although full lace extension units can be adhered around their edges to the wearer's scalp at the hair line, use of adhesive to secure the hair-supporting base of a lace weft would tend to bleed through the lace and cause the hair to tangle.

BRIEF SUMMARY

We have invented an individual lace weft that is practically invisible, that can be cut to length and/or width without unraveling or humping, that can be applied directly to the wearer's scalp in a part line with adhesive, that looks natural and flowing, and that can last from six to nine weeks per application. Our weft is also more comfortable and lays flatter than other wefts of which we are aware. Our weft requires less hair for a full-volume look as compared to other wefts. Removal of our weft with solvent is easier, since the lace substrate permits the solvent to penetrate the weft more effectively, reducing hair damage.

Our weft comprises a first (outer) base layer of a high quality extension lace such as "Swiss" or "French" lace or equivalent; strands of high quality extension hair knotted individually into the first base layer to define a lace/knot weft base of smaller area than the base layer, leaving a border of open, hair-free lace; a layer or application of knot sealant/bonding agent on the inner side of the first base layer and over the knots of the weft base area; and, a second (inner) base layer of lace bonded to the inner side of the first base layer over the knotted weft base.

In a further form, at least the knotted weft base portion of the first base layer is bleached, both lace and knots.

In a further form, the first base layer includes a weft base border defined by a reinforcing element such as a transparent monofilament or equivalent.

In a further form, our invention also includes the combination of our weft bonded with adhesive directly to the scalp along a part line.

Our invention also includes the method for forming the weft, including: defining a weft base in a first base layer of lace, the weft base having an area smaller than the area of the first base layer; knotting hair individually into the lace in the weft base area; bleaching both the knots and at least the weft base portion of the first base layer; applying a knot sealant/bonding agent to the inner side of the first base layer, including over the weft base area; and bonding a second layer of lace to the inner side of the first base layer to the sealant/bonding agent and over the sealed knots in the weft base.

In a further form our invention includes the method of applying the inventive weft to a wearer's head, including: parting the hair; trimming the open lace base layers away from the weft base; measuring and cutting the weft to the length and/or width of the part; applying a pre-bonding solution to the scalp along the part; making the pre-bonding solution tacky; and, applying the measured and cut weft to the pre-bonded scalp along the part. The order of some of these steps may vary according to the preference of the person applying the extension.

These and other features and advantages of the invention will become apparent from the detailed description below, in light of the accompanying drawings.

DETAILED DESCRIPTION

Figure 1:
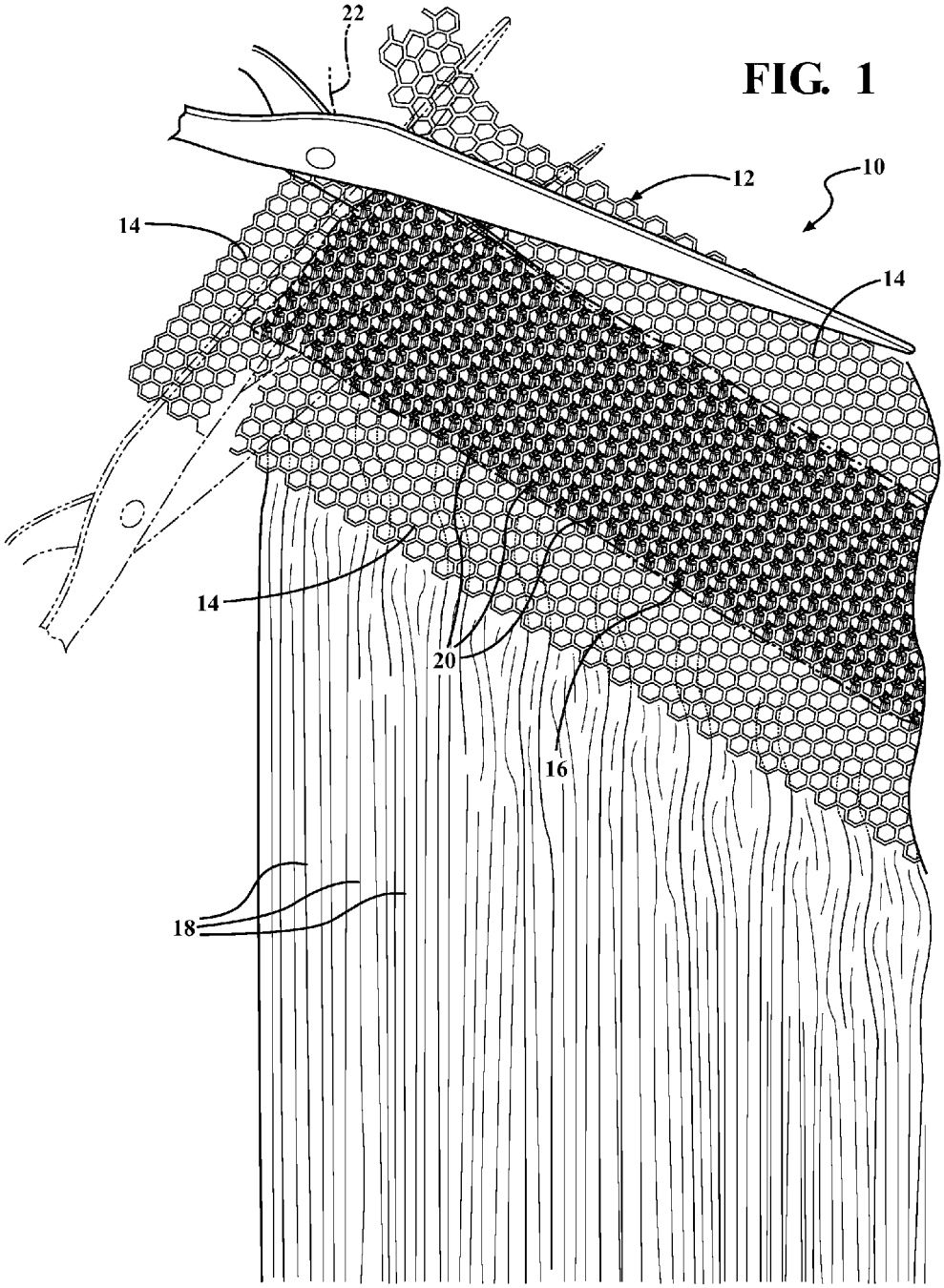
FIGS. 1 and 1A are bottom (scalp-side) perspective views of a lace wefts constructed according to our invention, with portions of open lace being trimmed away.

Referring first to FIG. 1, a lace weft extension 10 is shown in exemplary form in order to teach how to make and use the claimed invention. Extension 10 includes a lace base 12 made from French or Swiss lace (or equivalent) of the type known for use in full lace extension "units" or wigs. Base 12 includes an open lace area 14 surrounding the top, bottom, and side edges of a weft base 16.

Weft base 16 is the relatively narrow, longitudinal area of base 12 where extension hair 18 is secured to the lace by knots 20, preferably with each strand of hair 18 individually hand-tied to the lattice structure of the lace 12 in a manner generally known to those skilled in the art of making full lace extension units.

Weft 10 can be manufactured in any length. For example, the illustrated weft may be approximately 24" in length, with FIG. 1 showing a first end and part of the body of the weft, the remainder of the body and the other end of the weft being essentially identical to the portion shown in FIG. 1, i.e. the weft in its untrimmed state is a long, rectangular, essentially uniform structure. The weft 10 is normally cut to a shorter, custom length when being applied to a wearer's scalp. The open lace area 14 facilitates handling the weft 10 before the weft is applied, and provides the option of leaving a border of open lace around the weft base 16, if needed, for some hair extension applications. In FIG. 1 an end portion and one side of the open lace border 14 are shown being trimmed away with scissors.

In the illustrated example of FIG. 1, the hair 18 is fortified, double-drawn "remy" cuticle hair—natural, equal length, minimally processed hair flowing in the same direction, which when bundled in a weft produces a generally thicker and more consistent look than natural human hair. Lesser qualities of hair could be used, including both natural and synthetic types of hair, but we consider our lace construction to produce a superior quality weft warranting the use of premium hair.

The inner ends of hair 18 are knotted into lace 12, and preferably double-looped or double-knotted into the lace 12 for strength. At least the weft base area 16 of the extension is "double-bleached" after knotting, meaning that both lace 12 and knots 20 are bleached (at the same time). This double bleaching makes the lace and knots essentially invisible or transparent so that the weft blends seamlessly with the individual's scalp. Bleaching is known in the industry for the lining or lace perimeter of full hair-pieces, and known bleaching solutions and processes are suitable for the double bleaching of weft base 16. For example, regular professional powder bleach may be used, mixed 1:1 with 20%, 30%, or 40% developer, applied from the underside of the extension 10 (the inner or scalp-side viewed in FIG. 1) in a non-metallic container.

Weft base 16 may have a reinforcing border 22, in the illustrated example a fine, transparent monofilament of nylon or similar, that provides both a guideline for trimming away the open lace 14 around the weft base at the time of application, and that helps prevent any unraveling of the weft base 16 after it is cut and applied. We have found, however, that weft base 16 generally does not need a reinforced border 22 due to the multi-layer bonded construction of our lace extension, which will now be described in more detail.

Figure 2:
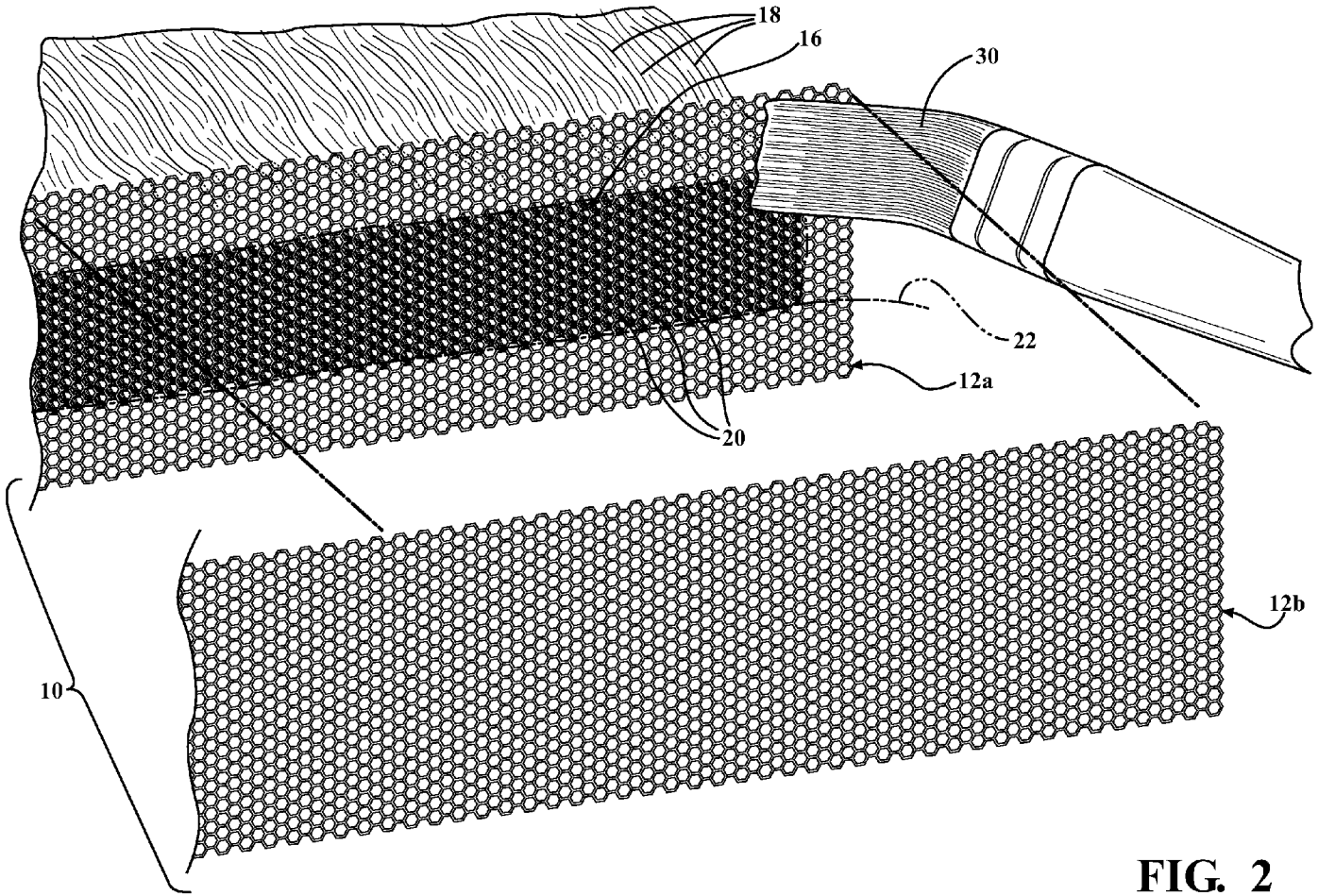
FIG. 2 is an exploded perspective view of the weft of FIG. 1.

FIG. 2 illustrates weft extension 10 in exploded manner to show its construction more clearly. Lace base 12 is formed from two layers 12*a* and 12*b* of matching lace, with hair 18 knotted to first layer 12*a*. Border 22 may be pre-formed in layer 12*a* before the hair is knotted in place, and may be a structurally-reinforced border as shown, or it may be merely a visible border to help define the weft base area 16 for the person knotting the hair.

Once hair 18 has been secured to first lace layer 12*a* by knots 20 to form the lace/knot weft base 16, at least the weft base portion 16 of base layer 12*a* is bleached (lace and knots), and preferably the entire base layer 12*a*. After the bleaching process, a knot sealant/bonding agent 30 such as a light polyurethane sealer is applied to or layered over the inner (knot) side of weft base 16, and additionally over the entire inner surface of first layer 12*a*. Second layer 12*b* of lace 12 is then applied and bonded to the inner side of layer 12*a*, over knots 20 and the weft base 16, with the lace structure and openings aligned so that the finished lace base 12 result looks like a single layer of lace.

Alternately, lace layers 12*a* and 12*b* can be bonded together first, then hair 18 knotted into weft base 16 and the knot sealant applied over the inner side of the weft base 16 over knots 20.

The knot sealant/bonding agent 30 is schematically illustrated in FIG. 2 by a manual brush applicator. It should be understood the agent 30 can be applied by any means capable of leaving a thin inner layer over the inner side of base layer 12*a* and the inner side of knots 20 in weft base 16 without bleeding through to hair 18, including but not limited to automated brushes or spray processes.

Figure 3:
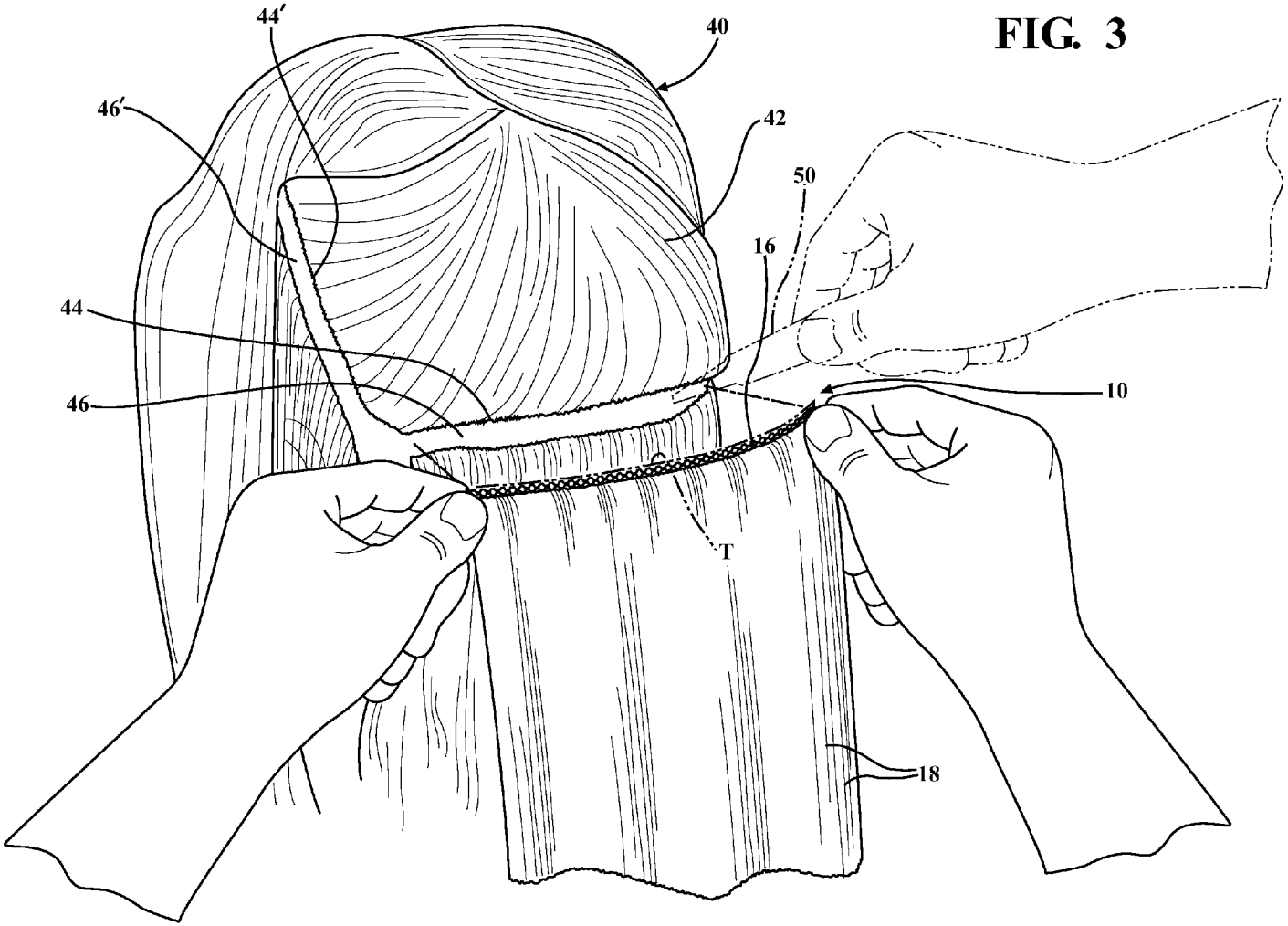
FIGS. 3 and 3A are top side perspective views of the wefts of FIGS. 1 and 1A, being applied to a part in a wearer's hair.

FIG. 3 shows a weft 10 being applied to the head 40 of a person wanting to supplement their natural hair 42 with the weft extension. A part 44 is formed in the wearer's hair 42 in known manner, exposing a strip of scalp 46 where the weft is to be applied. Weft 10 is trimmed to length and/or width to essentially match the exposed area of scalp 46 in part 44 where it is to be bonded, although the amount of un-bonded scalp left in the part around the weft will be a matter of skill and preference of the person applying the weft, and may vary. When trimming weft 10, the open lace border 14 (FIG. 1) around the hair-filled weft base 16 is usually removed completely, although for some applications it might be desirable to leave a small border of open lace around weft base 16. A scalp-compatible type of adhesive 50, referred to as a "pre-bonding solution", is applied to scalp 46 in part 44 with a suitable applicator (tube, brush, finger), and made tacky, for example with a blow-dryer on cool at low pressure. Measured and cut weft base 16 is then applied firmly into the section of the pre-bonded scalp 46 in part 44.

Figure 1A:
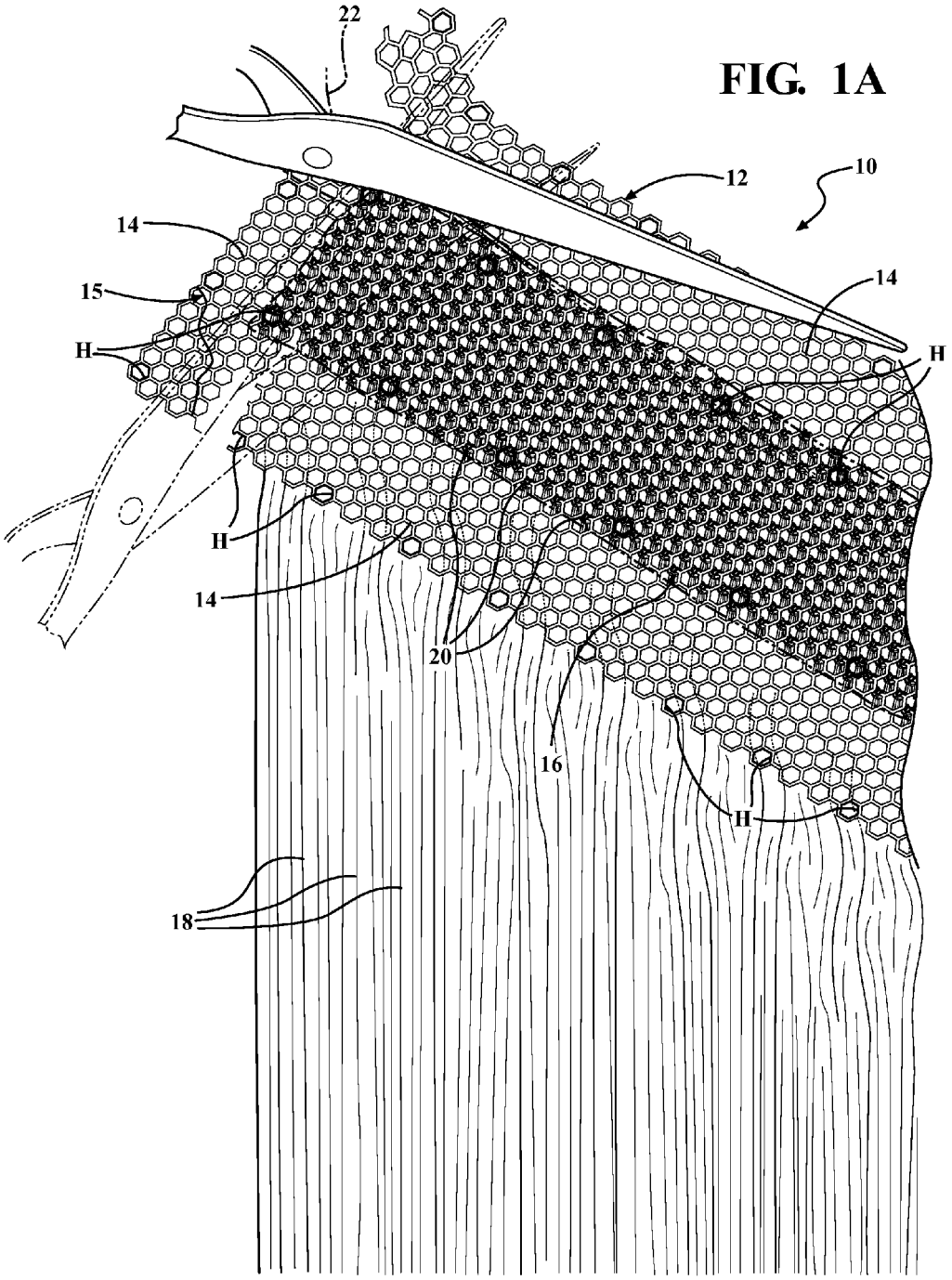
Figure 3A:
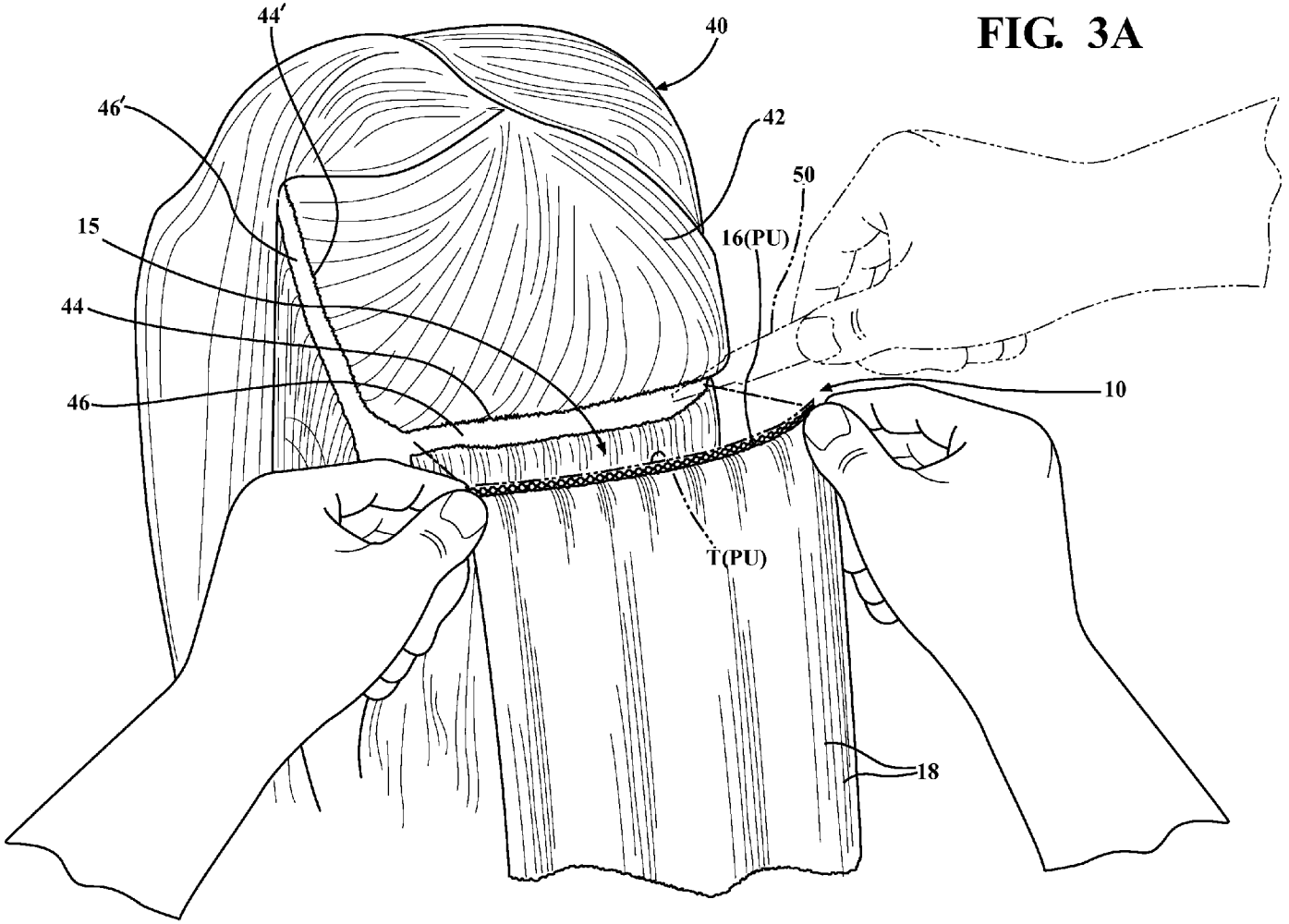

For greater security, especially where the scalp is oily, the weft may optionally be double-bonded to the scalp. This is done by applying bonding tape T to the inner side of the weft base 16 on the previously trimmed weft 10 (FIG. 3), and then applying pre-bonding solution directly to the outer (scalp-facing) side of the tape. The taped, pre-bonded weft 10 can then be applied to the layer of pre-bonding solution on the scalp when the pre-bonding solution on at least the scalp, and preferably on tape T as well, has been dried and made tacky. Tape T is of a type known in the hairstyling field for use with extensions, and is preferably double-sided (adhesive on both sides). FIGS. 1A and 3A show a further option where a heavier, thicker layer 15 of polyurethane (PU) or similar non-adhesive backing is added to the back or scalp-facing side of the weft base 16, as a reinforcement for adhesive and non-adhesive applications. The PU may be added in strip form, by way of non-limiting example, for example with pressure and/or heat. The PU is added at least in the region where the weft base 16 is currently illustrated, and in FIGS. 1A and 3A may be considered to be visually represented by weft base 16 and/or the tape T. Where an adhesive (either tape or bonding solution) application of the weft is desired, the adhesive may be applied over the PU backing layer as an option for attachment. For non-adhesive applications, FIGS. 1A and 3A also show double-loop holes (dark circles H)

formed through at least the PU backing layer to permit weaving the weft base into the wearer's natural hair. The holes are preferably formed along the entire length and sides of the PU layer-backed area 16, as well as in the interior of the PU layer-backed area, to allow custom cutting of the weft base both length- and width-wise.

While FIG. 3 shows a single weft 10 being applied to head 40, more than one weft 10 can be applied, and the above steps would be repeated for each application of a weft 10 to the wearer's head. While horizontal parts 44 are typical for weft application, our weft 10 can be applied at virtually any angle or contour line on a person's head, such as the more vertical part 44' and scalp line 46' shown in FIG. 3. Our weft base construction can be cut to almost any length, width, or contour without unraveling or humping, making it extremely versatile. It is even possible to cut into the knotted, hair-filled weft base 16 for an irregular contour or edge, and the weft base 16 will remain stable for applications lasting six weeks or longer.

Figure 4:
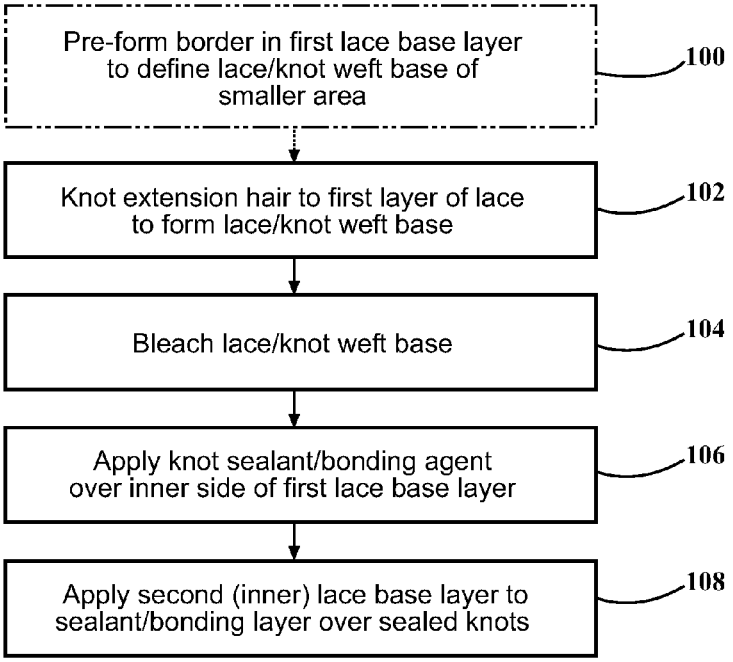
FIG. 4 is a flow diagram of a method for constructing the weft of FIG. 1 according to our invention.

FIG. 4 schematically illustrates the method of forming our weft 10 as shown in FIG. 2. Block 100 represents the optional step of defining, either structurally or visibly, the weft base area 16 where hair is to be knotted into the lace base layer. Block 102 represents the knotting of the extension hair 18 into the weft base area to define the hair-filled weft base 16. Block 104 represents the step of bleaching the weft base 16 and preferably the entire lace base 12 of the weft 10. Block 106 represents applying the knot sealant/bonding agent to the inner side of the first lace base layer 12*a* (and over the inner side of knots 20 in weft base 16). Block 108 represents applying the second lace base layer 12*b* over the inner side of first base layer 12*a* and the sealed knots to complete the weft structure.

Figure 5:
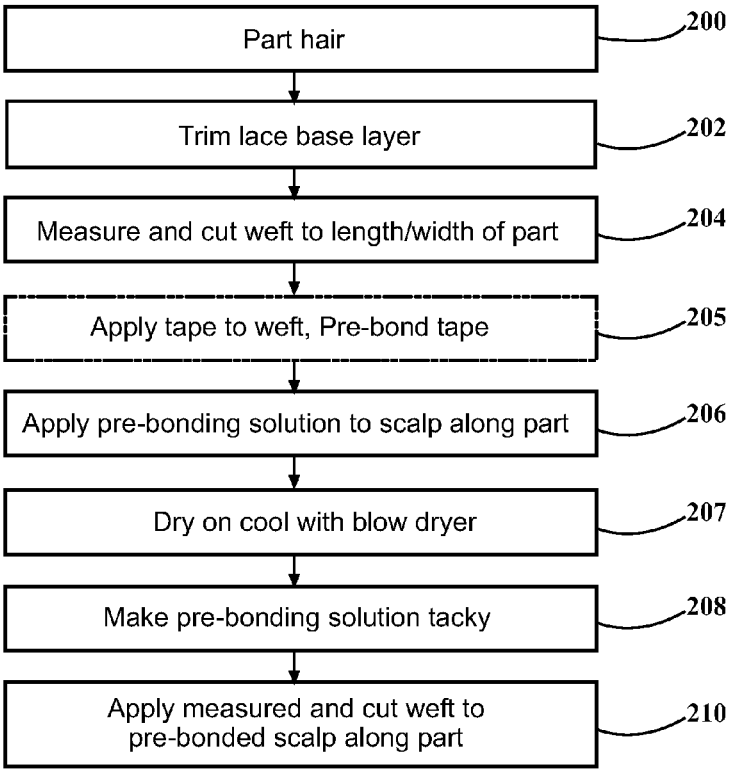
FIG. 5 is a flow diagram of a method for applying the weft of FIG. 1 according to our invention.

FIG. 5 schematically illustrates the method of applying our weft 10 to a wearer's head, as shown in FIG. 3. Block 200 represents forming a part in the wearer's hair to expose a portion of scalp to which the weft 10 will be bonded. Block 202 represents trimming the open lace border 14 from around the weft base 16—this step may also be performed earlier in the process, for example before the hair is parted, or later in the process, for example simultaneous with cutting the weft base 16 to length in block 204. Block 204 represents the measuring and cutting of the weft base 16 to length and/or width of the portion of the scalp 46 to which the weft 10 is to be bonded. Block 205 represents the option of applying tape T to the inner, scalp-facing side of weft base 16, and applying weft bonding solution to the scalp-facing side of the tape. Block 206 represents applying a weft-bonding solution to the scalp 46, for example a medical grade removable adhesive. Block 207 represents drying at least the bonding solution on the scalp with a cool blow dryer. Block 208 represents making at least the bonding solution applied to the scalp tacky, for example by tapping it with a comb, popsicle stick, or similar item. Block 210 represents applying the measured/cut weft 10 to the pre-bonded scalp 46 along part 44. It will be understood that the bonding solution applied to tape T at optional block 205 may also be dried and made tacky before applying the weft to the scalp at 210.

The weft 10 constructed and applied to the wearer's scalp as described above is capable of at least six to nine weeks of wear without maintenance or re-application, depending on the quality and type of lace used for lace base 12. The lace base is virtually invisible, and the extension hair 18 is thick and full and flowing, with natural-looking movement with the wearer's head. Removal of weft 10 from the wearer's scalp is also improved over prior weft technology—for example, alcohol-based lace top remover can simply be sprayed onto the outer surface of the lace weft base 16 to loosen the bond between lace and scalp, with the openings in the lace and between the knots allowing the alcohol to penetrate directly to the bonding material, and preventing damage to the surrounding hair in the part.

It will finally be understood that the disclosed embodiments represent presently preferred examples of how to make and use the invention, but are intended to enable rather than limit the invention. Variations and modifications of the illustrated examples in the foregoing written specification and drawings may be possible without departing from the scope of the invention. It should further be understood that to the extent the term "invention" is used in the written specification, it is not to be construed as a limiting term as to number of claimed or disclosed inventions or discoveries or the scope of any such invention or discovery, but as a term which has long been conveniently and widely used to describe new and useful improvements in science and the useful arts. The scope of the invention should accordingly be construed by what the above disclosure teaches and suggests to those skilled in the art, and by any claims that the above disclosure supports in this provisional application or in any non-provisional application claiming priority to this provisional application.

What is claimed:

1. A hair weft extension, comprising:

a lace base comprising an outer first layer of lace comprising lace structure and openings, the lace base further comprising an inner second layer of lace comprising lace structure and openings, the second layer of lace bonded to an inner side of the first layer of lace;

strands of extension hair knotted into at least the first layer of lace to define a weft base area in the lace base comprising knots, at least the weft base area being bleached;

a layer or application of knot sealant/bonding agent over the knots of the weft base area; and, wherein the lace structure and openings of the first and second layers of lace are substantially aligned so that the lace base appears to be a single layer of lace.

2. The hair weft extension of claim 1, wherein the weft base area is of smaller area than an area of the lace base, leaving a border of open, hair-free lace along one or more sides of the weft base area.

3. The hair weft extension of claim 1, further comprising a layer of polyurethane or equivalent non-adhesive backer heavier and thicker than the layer or application of the knot sealant/bonding agent on a scalp-facing side of the lace base over a backing area corresponding at least to the weft base area.

4. The hair weft extension of claim 3, further including holes formed through the lace base and backer in the backing area to permit weaving the weft base into a wearer's natural hair.

5. The hair weft extension of claim 1, wherein the strands of hair are knotted into the first layer of lace in the weft base area and the second layer of lace is bonded to the inner side of the first layer of lace over the knots and the knot sealant/bonding agent.

6. The hair weft extension of claim 1, wherein the strands of hair are knotted into the bonded first and second layers of lace and the knots are sealed with the knot sealant/bonding agent over an inner scalp-facing side of the second layer of lace.

7. A hair weft system comprising:

a lace base comprising an outer first layer of lace comprising lace structure and openings, the lace base further comprising an inner second layer of lace comprising lace structure and openings, the second layer of lace bonded to an inner side of the first layer of lace;

strands of extension hair knotted into at least the first layer of lace to define a weft base area in the lace base comprising knots, at least the weft base area being bleached;

a layer or application of knot sealant/bonding agent over the knots of the weft base area; and, wherein the lace structure and openings of the first and second layers of lace are substantially aligned so that the lace base appears to be a single layer of lace; wherein, at least a portion of the weft base area of the lace base is adhesively bonded to a wearer's scalp along a part.

8. The hair weft system of claim 7, wherein the weft base area is smaller than an area of the lace base, leaving a border of open, hair-free lace along one or more sides of the weft base area.

9. The hair weft system of claim 7, further comprising a layer of polyurethane or equivalent non-adhesive backer heavier and thicker than the layer or application of the knot sealant/bonding agent to on a scalp-facing side of the lace base over a backing area corresponding at least to the weft base area.

10. The hair weft system of claim 9, wherein the hacker is adhesively bonded to the wearer's scalp along the part.

11. The hair weft system of claim 9, further including holes formed through the lace base and backer in the backing area, and wherein the weft is woven into the wearer's natural hair via the holes.

12. A method for making a hair weft extension, comprising:

bonding an inner second layer of lace with lace structure and openings to an inner side of an outer first layer of lace with lace structure and openings to form a lace base;

knotting strands of extension hair into at least the first layer of lace to define a weft base area in the lace base comprising knots;

bleaching the weft base area;

applying a layer or application of knot sealant/bonding agent over the knots of the weft base area; and, wherein during the bonding of the first and second layers of lace the lace structure and openings of the first and second layers of lace are substantially aligned so that the lace base appears to be a single layer of lace.

13. The method of claim 12, wherein the weft base area is smaller than an area of the lace base, leaving a border of open, hair-free lace along one or more sides of the weft base area.

14. The method of claim 13, further including trimming at least some of the border of open, hair-free lace from the lace base along the weft base area prior to applying the weft to a wearer's head.

15. The method of claim 12, further including adhesively bonding at least a portion of the weft base area to a wearer's scalp along a part.

16. The method of claim 15, wherein adhesively bonding at least a portion of the weft base area to a wearer's scalp along a part line includes parting the hair, applying a pre-bonding solution to the scalp along the part, making the pre-bonding solution tacky, and applying at least a portion of the weft base area to the pre-bonded scalp along the part.

17. The method of claim 16, wherein adhesively bonding at least a portion of the weft base area to a wearer's scalp along a part includes double-bonding the weft to the scalp by applying a bonding tape with a scalp-facing adhesive side to the inner side of at least a portion of the weft base area, and further by applying pre-bonding solution directly to the scalp-facing adhesive side of the bonding tape prior to applying the at least a portion of the weft base area to the pre-bonded scalp along the part.

18. The method of claim 15, further including applying a layer of polyurethane or equivalent non-adhesive backer heavier and thicker than the layer or application of the knot sealant/bonding agent to a scalp-facing side of the lace base over a backing area corresponding at least to the weft base area prior to adhesively bonding the at least a portion of the weft base area to a wearer's scalp along the part.

19. The method of claim 18, further including forming holes through the lace base and hacker in the backing area to permit weaving the weft base into a wearer's natural hair.

* * * * *

UNITED STATES PATENT AND TRADEMARK OFFICE

CERTIFICATE OF CORRECTION

PATENT NO. : 8,905,048 B2
APPLICATION NO. : 13/750718
DATED : December 9, 2014
INVENTOR(S) : Peterson et al.

It is certified that error appears in the above-identified patent and that said Letters Patent is hereby corrected as shown below:

In the Claims

Col. 7, Claim 9, line 20, after “agent” delete “to”.

Col. 7, Claim 10, line 23, replace “hacker” with -- backer --.

Col. 8, Claim 16, line 16, after “part” delete “line”.

Signed and Sealed this
Twenty-fourth Day of March, 2015

Michelle K. Lee

Michelle K. Lee
*Director of the United States Patent and Trademark Office*